US011129481B2

(12) United States Patent
Fry

(10) Patent No.: US 11,129,481 B2
(45) Date of Patent: Sep. 28, 2021

(54) INFLATABLE MATTRESS WITH AIR LEAK REPAIR HOSE

(71) Applicant: Brandon C Fry, Pacific, MO (US)

(72) Inventor: Brandon C Fry, Pacific, MO (US)

( * ) Notice: Subject to any disclaimer, the term of this patent is extended or adjusted under 35 U.S.C. 154(b) by 384 days.

(21) Appl. No.: 16/501,192

(22) Filed: Mar. 5, 2019

(65) Prior Publication Data

US 2019/0231082 A1 Aug. 1, 2019

Related U.S. Application Data

(63) Continuation of application No. 14/998,695, filed on Feb. 3, 2016, now abandoned.

(60) Provisional application No. 62/176,610, filed on Feb. 23, 2015.

(51) Int. Cl.
*A47C 27/08* (2006.01)
*A47C 27/10* (2006.01)

(52) U.S. Cl.
CPC ..... *A47C 27/082* (2013.01); *A47C 27/081* (2013.01); *A47C 27/088* (2013.01); *A47C 27/10* (2013.01)

(58) Field of Classification Search
CPC ... A47C 27/081; A47C 27/082; A47C 27/083; A47C 27/088; A47C 27/10
See application file for complete search history.

(56) References Cited

U.S. PATENT DOCUMENTS 3,042,941 A * 7/1962 Marcus ..... A47C 27/088 5/708
3,638,253 A * 2/1972 Stumpf ..... A47G 9/1027 5/644
3,729,754 A * 5/1973 Hastings ..... A47C 27/081 5/655.3
3,798,686 A * 3/1974 Gaiser ..... A47C 27/088 5/413 AM
4,780,921 A * 11/1988 Lahn ..... A47C 20/027 5/490
4,788,729 A * 12/1988 Walker ..... A47C 27/081 137/557
4,862,533 A * 9/1989 Adams, III ..... A47C 27/081 5/413 R
4,908,895 A * 3/1990 Walker ..... A47C 27/081 5/706
5,699,570 A * 12/1997 Wilkinson ..... A47C 27/082 5/713

(Continued)

FOREIGN PATENT DOCUMENTS

CA 2923751 A1 * 4/2015 ..... A47C 27/081
CH 609850 A5 * 3/1979 ..... A47C 27/18

(Continued)

*Primary Examiner* — Michael Safavi
(74) *Attorney, Agent, or Firm* — Paul M. Denk

(57) ABSTRACT

An air leak repair hose for inflatable air mattress, particularly when the hose or tubing system, or its fittings, break because of forceful handling, but can be repaired through the application of a supplemental hose to the remaining portion of any broke fitting, or glued in place within the opening into the air chamber of the mattress, with a new fitting applied to the opposite end of the segment of the supplemental hose, that can be connected with the air pump, in preparation for refilling of the air mattress(s) to the firmness desired by the user.

5 Claims, 5 Drawing Sheets

(56) References Cited

U.S. PATENT DOCUMENTS

| | | | | |
|---|---|---|---|---|
| 5,806,928 | A * | 9/1998 | Gattuso | A47C 27/081 297/284.6 |
| 6,038,722 | A * | 3/2000 | Giori | A47C 27/084 5/709 |
| 6,643,875 | B2 * | 11/2003 | Boso | A47C 27/082 5/691 |
| 6,868,569 | B2 * | 3/2005 | VanSteenburg | A47C 27/081 5/709 |
| 6,889,398 | B2 * | 5/2005 | Lewis | A47C 23/047 5/716 |
| 7,120,950 | B2 * | 10/2006 | Garrigues | A47C 27/088 5/420 |
| 7,174,589 | B2 * | 2/2007 | Mileti | A47C 27/001 5/699 |
| 7,455,744 | B2 * | 11/2008 | Mileti | A47C 27/001 156/145 |
| 7,712,164 | B2 * | 5/2010 | Chambers | A47C 21/044 5/423 |
| 9,254,047 | B1 * | 2/2016 | Schermel | A47C 27/082 |
| 9,510,689 | B2 * | 12/2016 | Kearse | A47C 27/088 |
| 10,342,322 | B2 * | 7/2019 | Evatt | C02F 1/002 |
| 10,441,087 | B2 * | 10/2019 | Karschnik | A47C 27/084 |
| 10,646,044 | B2 * | 5/2020 | Jones | A47C 27/10 |
| 2003/0163874 | A1 * | 9/2003 | Boso | A47C 27/082 5/713 |
| 2003/0229943 | A1 * | 12/2003 | Lewis | A47C 23/047 5/716 |
| 2004/0003471 | A1 * | 1/2004 | VanSteenburg | A47C 27/081 5/709 |
| 2005/0056314 | A1 * | 3/2005 | Lin | A47C 27/081 137/223 |
| 2005/0097674 | A1 * | 5/2005 | Mileti | A61G 7/05784 5/710 |
| 2006/0080778 | A1 * | 4/2006 | Chambers | A47C 27/082 5/652.2 |
| 2007/0226912 | A1 * | 10/2007 | Mileti | A47C 27/10 5/711 |
| 2014/0082836 | A1 * | 3/2014 | Patrick | A61G 1/02 5/81.1 HS |
| 2014/0137332 | A1 * | 5/2014 | McGuire | A47C 27/10 5/713 |
| 2015/0164237 | A1 * | 6/2015 | Kearse | A47C 7/021 5/652.1 |
| 2016/0242562 | A1 * | 8/2016 | Karschnik | A47C 27/084 |
| 2016/0255967 | A1 * | 9/2016 | Katan | A47C 27/08 |
| 2017/0150819 | A1 * | 6/2017 | Jones | A47C 7/18 |

FOREIGN PATENT DOCUMENTS

| | | | | |
|---|---|---|---|---|
| DE | 2819406 | A1 * | 11/1979 | A47C 27/081 |
| FR | 1189939 | A * | 10/1959 | B63C 9/24 |
| FR | 1378588 | A * | 11/1964 | A47C 27/081 |
| WO | WO-9519517 | A1 * | 7/1995 | A47C 27/081 |
| WO | WO-2007043234 | A1 * | 4/2007 | A47C 4/54 |

* cited by examiner

INFLATABLE MATTRESS WITH AIR LEAK REPAIR HOSE

CROSS REFERENCE TO RELATED APPLICATION

This invention and patent application is a continuation of the non-provisional application Ser. No. 14/998,695, filed on Feb. 3, 2016, which is the non-provisional application of the provisional application filed on Feb. 23, 2015, under Ser. No. 62/176,610.

FIELD OF THE INVENTION

This invention relates generally to air mattresses, of the one or two air chambers/bladders that provide different settings for the softness or hardness of the mattress for the individual comfort of the user(s), and more particularly, relates to an improved connection system for attachment of the air pump to the air chamber system in order to remedy any air leaks that have occurred due to breakage or wear-out of the fittings that connect the air pump(s) to the single or dual bladder systems.

BACKGROUND OF THE INVENTION

As most people know, there air various types of air bladder form of mattresses that can accept air under pressure that regulates the degree of firmness of the mattress during usage. Most sleepers have their comfort zone that can be satisfied by a particular firmness to the mattress, either through the injection of a lower level of pressurized air, in order to achieve softness, or the injection of a greater amount of pressurized air, to enhance the hardness or firmness of the mattress during usage. Many of these beds, whether they have a single chamber or bladder, or are of the double, queen size and king size beds, that offer dual mattresses, having separate air chambers for either side, these types of beds do accept the entrance of pressurized air within their bladders, through pumping arrangements, that can provide for that degree of firmness desired by the individual users, once their respective settings have been achieved, through the injection of pressurized air to desired levels.

More popular to the market place, there are those beds identified as the Sleep Number beds, and other air beds of similar construction, that do include those one or two air bladders that offer these different settings for each sleeper, where any sleeper can adjust the level of air in the bladder on their own side, to achieve a desired support level of their own. Customers can find high satisfaction in the usage of these types of mattresses, and frankly grow to love them, until it encounters heretofore irreparable air leaks.

These type of multi-zone fluid or air chambers and mattress systems can be seen in a variety of prior art patents, such as in U.S. Pat. Nos. 8,966,689, 8,893,339, 8,769,747, 7,865,988, 6,952,852, showing mattress structures, that contain inflatable bladders, U.S. Pat. Nos. 6,763,541, and 6,483,264. These are examples of the fluid type mattresses, generally of the compressed air type, that provide for inflated bladder(s) that make up their construction.

The type of air pump that may be used with these bladders is shown in the air pump patent No. U.S. D701,536, and this type of pump generally is provided within the mattress structure, or below the same, and fits into a compartment usually below the two mattresses, where a double bed is involved, and has interconnecting hoses for providing for a direct delivery of air from the pump, when fill up air is necessary, or additional pressurized air is required, in order to attain the degree of firmness sought by the users.

Where the various valving, are connected with the air hoses from the pump, are interconnected, there is usually applied a two piece molded female/male coupling, that interconnect the pump hose with the coupling within the mattress, or just at its periphery, that provides for interconnection between the mattress bladders, and the pump, for usage when the pump action is initiated. An example of this type of coupling can be seen in the U.S. Pat. No. 5,052,725, identified as a two piece molded female coupling.

If the coupling, or this coupler adaptor cracks, or breaks off, or the tubular cylindrical male fitting with its O-ring is damages, or breaks off, or if it wears out to the point where air leakage occurs, the bladder becomes unusable, currently requiring a repurchase of the entire mattress bladder system, as a replacement. In addition, when the user attempts to remove the pump hose, from the coupling, two unfavorable events can occur, that likewise makes the bladder system unusable. One, when the pump hose is pulled too forcefully, it can pull that coupling out of the edge of the bladder, which, once again, makes it totally unusable. Or, if too much pressure is applied to the hose, such as pulling downwardly from its coupling, it can occur that the O-ring at the outer end of the male coupling can crack, breaking off the O-ring, in addition to the outer hull of the male fitting, meaning that the air seal between the pump hose, and the previous coupling becomes totally impaired, and just can not be repaired by the mattress user. When that occurs, it is quite obvious that the cracked O-rings and air hose attachments cause the support chamber for the air bed to be unable to hold air under pressure. In particular, the O-ring that provides an air tight seal for the pump and the air bladder system is just compromised, or broken off. The beveled plastic portion of the cylindrical port for the coupler heretofore called the broken hull, just can not be repaired, the remaining bladder coupler has no way of being removed, and reattached with a new one, to provide an air tight seal that allows continued usage of the mattress.

This air tight seal is what makes the bed, and its firm controllable mattress, to be used, and without such an air tight seal, the pump and the air chambers/bladders can not be regulated, and there is no way to maintain air pressure to a given firmness setting just making the bed unusable.

Heretofore, usually when such predicaments occur, the manufacture would simply suggest a replacement of the entire bladder, or its pump, usually at significant price to the consumer.

SUMMARY OF THE INVENTION

This invention contemplates means for repairing the hose and coupler connection between an air pump and the air bladder of a mattress, in order to prevent leakage, and to allow for regulation of the firmness of the mattress setting, through the injection of pressurized air therein.

Generally, the air control system provides an air bladder that incorporates a coupler, with an O-ring by design, that is permanently attached to the air bladder through the use of a bonded latex, during its assembly by the manufacture. This male coupler has a small lip at the head end of the fitting, also known as the hull, that can and does break off, when excessive pressure is applied, causing it to release the air inside of the receptacle on the end of the air pump hose. Normally, the coupler requires the use of its O-ring within its pump hose, to form that air tight seal by design, and the plastic bevel of the hull, that holds the O-ring onto the male coupler, can and does break off. This usually occurs when the mattress owner forcefully applies pressure onto the pump hose, trying to separate the same, from the coupler, which just simply fractures under such pressure. This leaves the remaining piece of the plastic coupler stuck inside of the bonded latex area of the air bladder. It is wide open for the release of air, and obviously can not hold any air if it should be injected therein under pressure.

The issue of air leaking and having the fitting inside the zipper cover of the bladder, behind and below the support foam rails, creates undue wear on these essential couplers and fittings.

The design upgrade of this current invention requires getting the air connection outside of the air chamber area. Having the fittings inside the zippered cover, and below the foam support rails causes that cracking of the fittings, and their being pulled out of the bladder chamber, during such handling. Commonly in the past, customers would try to glue the old fitting back inside of the bladder, causing the connection to still be inside of the zipper mattress cover. With this current improvement, it provides a permanent seal at the air bladder, by using the remaining piece of the fitting still attached to the bonded latex area of the air bladder. The remaining part of the male fitting is receptive to a length of new hose, that is forcefully applied onto the remaining piece of the broken fitting, and it can provide for an air tight seal because of its tight fitting, or some glue may be applied onto the remaining male fitting to accept the length of hose thereon. In addition, by adding a new male fitting with its O-ring end on the outer end of the new length of hose, the pump hose receptacle now has a new matching male partner to form the air tight seal as required to keep the air bladder available for reception of additional air under pressure, to provide for that adjustable air bed functioning, and setting of its firmness, without having to purchase a new air chamber, bladder, or pump system, as heretofore required in the art.

Hence, by providing this supplemental length of hose, it brings the fitting exteriorly of the air chamber bladder, its air system, and its zipper cover or support foam rails, and makes the new male fitting readily accessible to interconnection with the air pump, for immediate reusage of the air chambers/bladders system.

Hence, it is the principal object of this invention to provide means for removing the male coupling component of an air conduit system from within the confines of the air mattress, its zipper cover, and its foam support rails, so as to furnish a new male fitting that is exterior of these components, of the air mattress, and makes it readily available for interconnection with the pump system for the air mattress.

Another object of this invention is to provide a unique kit, of a length of hose, a new male fitting, all of which can be connected with the broken fitting of an air mattress, to make it readily available for manual interconnection with the pump system for an air mattress.

Another object of this invention is to provide a length of tubing, with a supplemental male fitting, wherein the tubing can be inserted within the open hole of an air mattress where the previous male fitting was inadvertently removed, by force, and with the new hose glued in place, to provide not only a new interconnection between the supplemental hose, the air mattress, but provide a male fitting that is exteriorly located from the mattress, to provide for its immediate interconnection with the pump, for continued operations of the adjustable air mattress system.

A further object of this invention is to provide a method for fixing leaks occurring in an air mattress system particularly where its male fitting has deteriorated, or become broken, through inadvertent usage.

These and other objects may become more apparent to those skilled in the art upon review of the summary of the invention as provided herein, and upon undertaken a study of the description of its preferred embodiments, in view of the drawings.

BRIEF DESCRIPTION OF THE DRAWINGS

In referring to the drawings:

FIGS. 8*a* and 8*b* shows an isometric view of the inflatable mattress, in the first figure disclosing the singular hoses leading to each of the two sections of the air mattress, while FIG. 8*b* shows a single tube for transmitting pressurized air to the shown in the single air mattress.

DESCRIPTION OF THE PREFERRED EMBODIMENT

Figure 1A:
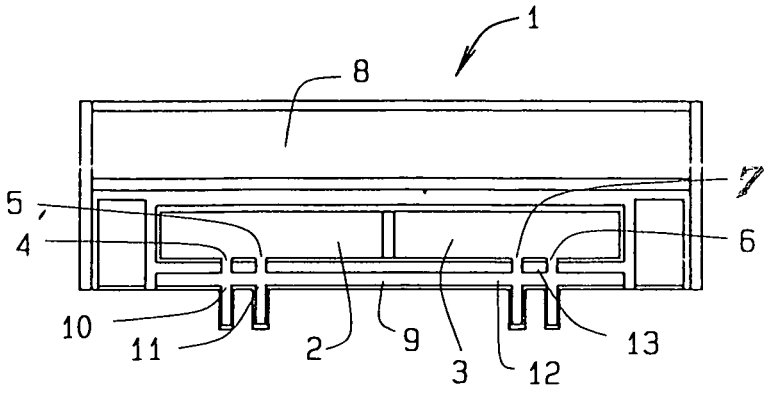
FIG. 1*a* shows a schematic view of the placement of the various air hose connections on a four hose air inflatable mattress.

In referring to the drawings, and in particular FIG. 1*a*, therein as shown is an end view of an inflatable mattress 1 with air chamber 2 and 3, and incorporating a four hose system having entrances to the air chambers as shown at 4, 5, 6, and 7, as noted. This being a four hose air system, sometimes incorporating one small hose, as at 5 and 6, and one large hose, as can be seen at 4 and 7, for each of the shown air chambers. These are the left and right hand side connections, that are located inside the zipper mattress cover for the system, and located below the foam support rail 8 at the head of the mattress, and further being raised by a multi inch base of foam 9 as noted. The location of these various constructions add to the applied pressure exerted upon the bladder segments, and because of the generally internal connection of these hoses to the bladder, can have excessive wear applied to them, during continued usage. The male fittings with their O-rings operatively associated with each of the aforesaid hose systems include the male fittings 10, 11, 12, and 13.

Figure 1B:
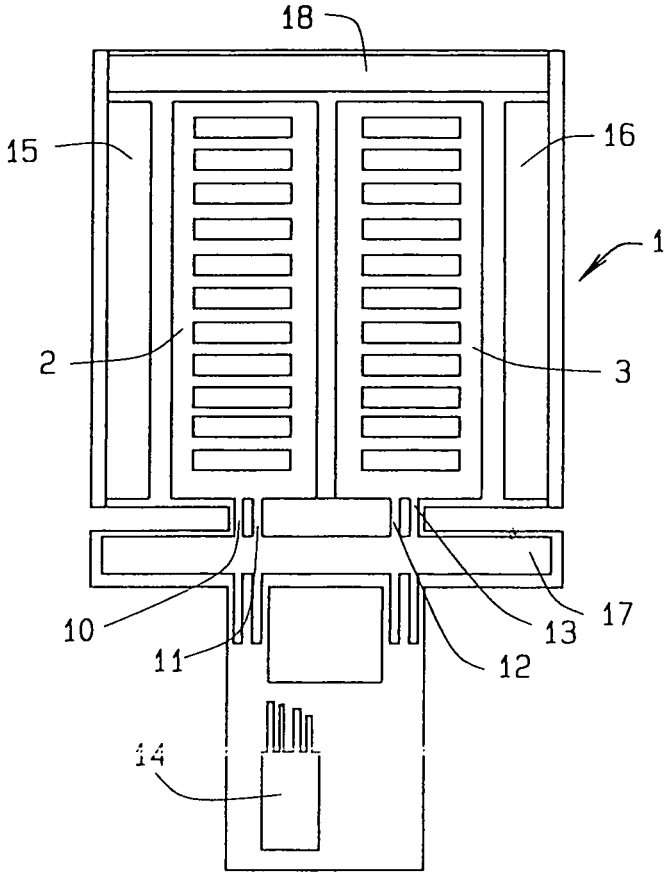
FIG. 1*b* shows a schematic view of the four hose air inflatable mattress system in a top view showing the air hose connections on such a four hose system.

FIG. 1*b* shows a plan view of the air inflatable mattress 1 of this invention. It shows its hose pump 14 and the first and second air chambers 2 and 3, as previously reviewed. This shows the left side air chamber 2, the right side air chamber 3, the air pump system 14, the left side rail 15 and the right side rail 16. In addition, the head rail 17 and a foot rail 18 and these all surround the air hose connections 10, 11, 12, and 13. This describes the multi bladder arrangement for the mattress system, where there are a pair of intake hoses operatively associated with each of the air bladder structures.

Figure 1C:
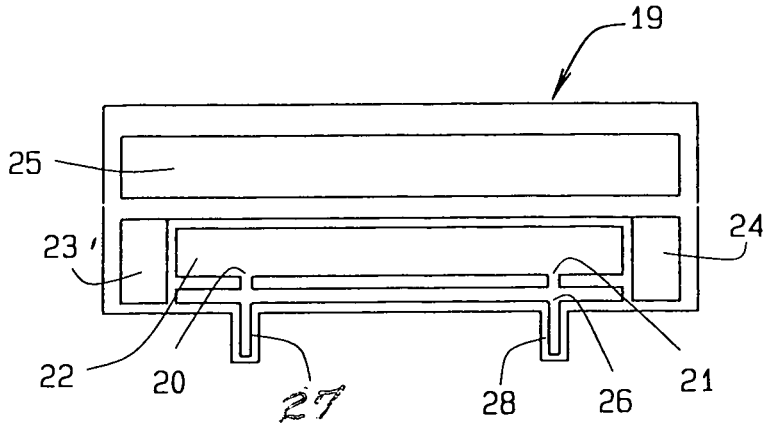
FIG. 1*c* shows a schematic view of the placement of the air hoses with a two hose air mattress system.

FIG. 1*c* shows an end view of an air chamber mattress system, as noted at 19. As shown, a left hose 20 and a right hose 21 are disclosed entering into the air chamber or bladder 22, contained within the left side rail 23 and the right side rail 24 the head rail for the bed is noted at 25. There is also a foam base 26 provided below the air chamber 22, as can be noted. The air pump connections are made with the fittings 27 and 28, as shown.

Figure 1D:
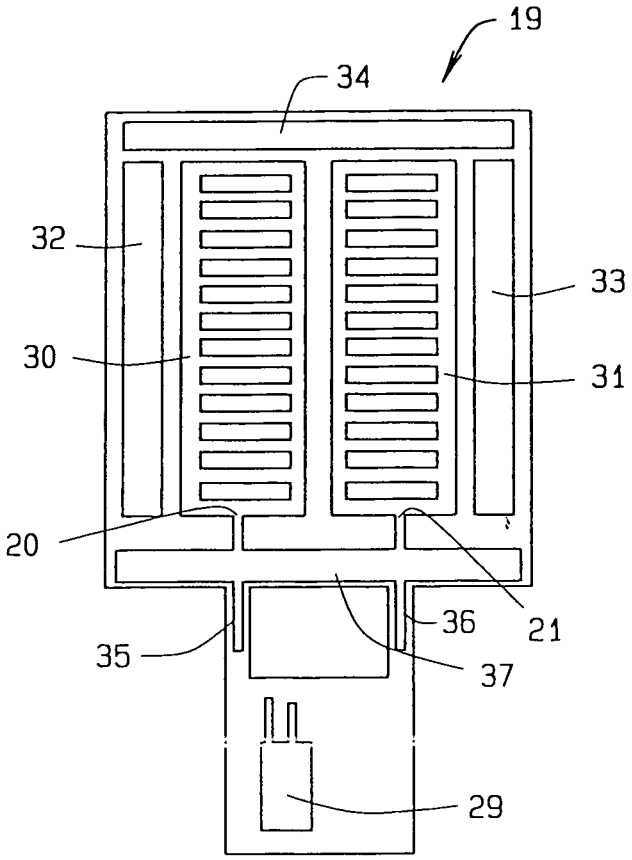
FIG. 1*d* is a top plan and schematic view of the hose placement for a two hose dual pressurized air mattress system.

The plan view for the two hose air mattress system is shown in a schematic view in FIG. 1*d*. As noted, the air chamber mattress is injected with pressurized air by means of the pump 29. The air chamber system including the bladders 30 and 31 are what are injected with the pressurized air, in order to attain the degree of hardness or firmness for the mattress as specified and desired by the users. There is a left side foam rail 32 adjacent the air chamber 30, and a right side foam rail 33 adjacent the air chamber 31. There is also a foam rail at the foot 34 of the bed, and another foam rail 37 at the head of the formed bed. The air hose connections 20 and 21 are provided inside the zipper mattress cover for the air chambers, and arranged below the head rail of the air mattress. In addition, the couplers or fittings 35 and 36 are provided, for connection of the air pump 29 thereto, when it is required to inject further air into the air chambers, during their functioning.

The foregoing is an example of the structural arrangement that makes up, broadly, the structure of the air chambers for the inflatable mattresses of the current invention. It describes how there are two hose and four hose type of injection systems, from the pump, that provides for filling of the air chambers of the mattress through the interconnection of their various pump hoses with the connectors for the injection systems.

With the foregoing description of the inflatable air mattress systems, the problems as previously described, and the methods for assembling their components to remedy and repair any problems, can be described hereinafter.

Figure 2:
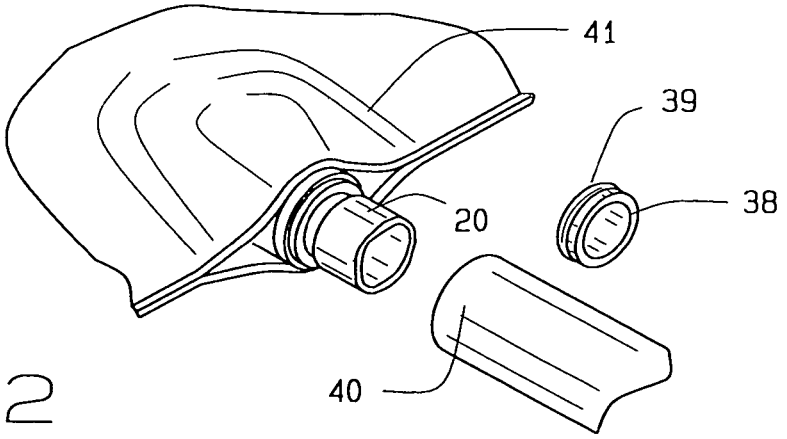
FIG. 2 is an isometric view of the male fitting of the coupling as broken off and showing its preparation for the application of a new length of hose as a means for repair for the broken male fitting.
Figure 3:
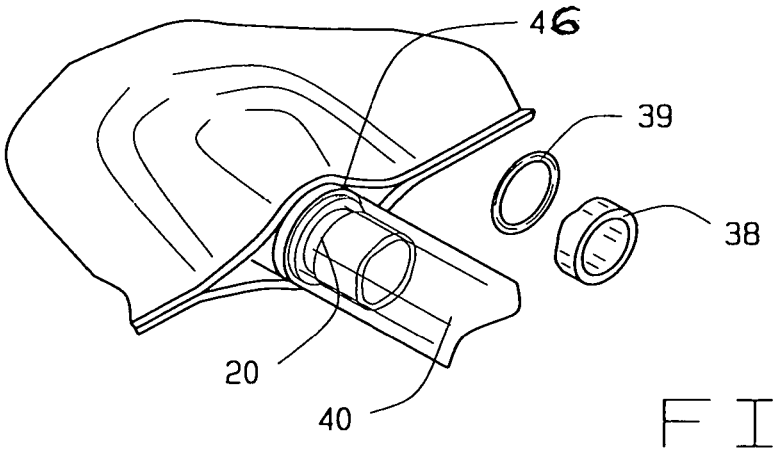
FIG. 3 is an isometric view showing the supplemental hose applied over the remaining broken male fitting as a means for furnishing a solid seal for operations of the air inflatable mattress system.
Figure 4:
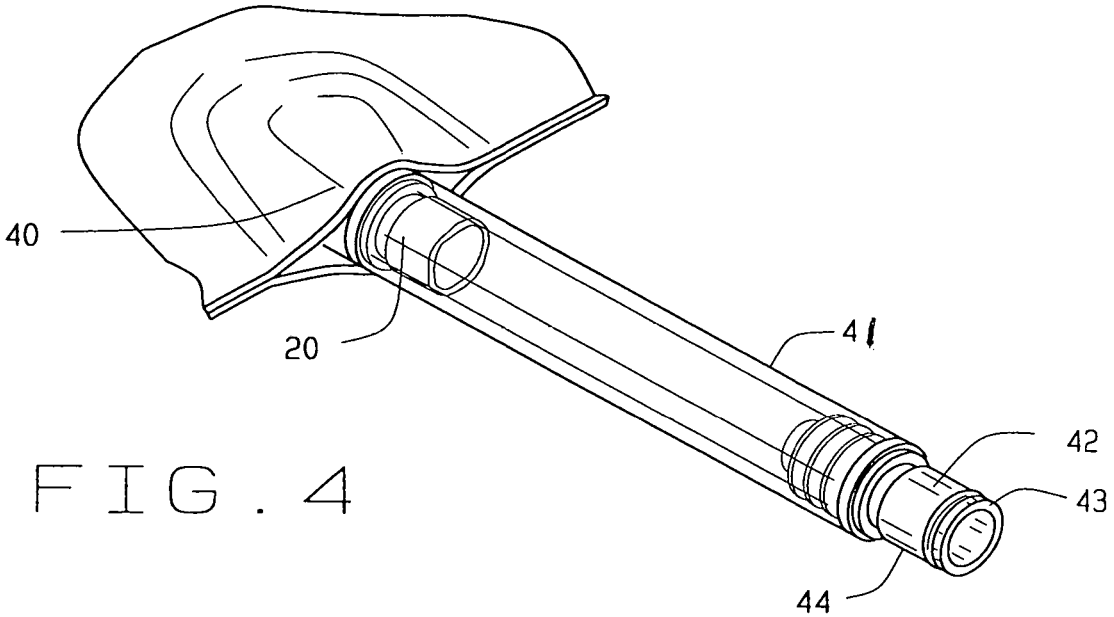
FIG. 4 shows the fully assembled supplemental hose system, with its new male fitting, extending exteriorly from the mattress air chamber to which the hose has been applied to its broken fitting, in the manner as also shown in FIG. 3.

FIG. 2 is a drawing of the air chamber fittings 20 or 21, and it shows to the side the broken hull of the fitting or coupler, as at 38, with its location for an O-ring 39, but since it has broken free from its fitting or coupler 20, the fitting is worthless, and any means to connect the pump to it simply leaks, or allows leakage from the air mattress, once filled. The standard tube fitting from the pump that had previously been located thereon, is no longer useful. But, through the correction as provided with the modified structure of the current invention, a new section of tube, as noted at 39, and which will very tightly secure onto the remaining portion of the fitting 20, is located in alignment for potential installation onto the broken fitting, as noted. Then, as can be seen in FIG. 3, the new hose 39 is stretched over the remaining male fitting 20 and creates a very air tight seal at the bonded latex area 40 of the air chamber for the shown mattress. And, as previously explained, the remaining portion of the fitting 20 is tightly bonded within the latex area 41*a* of the air chamber, and if it is pulled out, there is just no way to replace it. Hence, by tightly applying the end of the tube 39 onto the remaining portion of the fitting, this furnishes an air tight seal in preparation for injection of the pressurized air, from one of the pumps 14 or 29, into the section of the air mattress associated with the remaining portion of the fitting 20. As noted in FIG. 4, the new tube 40 is now applied in position upon the broken section of the male fitting or coupler 20, and extends for some length, 8 inches more or less, to its opposite end, where a supplemental fitting 42 is tightly secured in place within the shown section of tube, and ready for application of the hose from any pump thereon, to complete the repaired air injection system for the chamber of the air mattress. As can be seen, the supplemental fitting includes a slotted section 43 which contains an O-ring 44 to which the pump system can be hermetically sealed, in preparation for an air injection operation.

Figure 5:
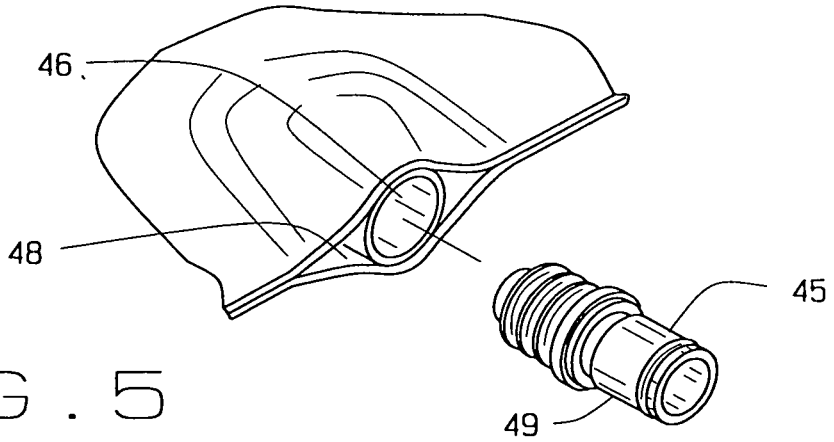
FIG. 5 provides an isometric view of a male fitting inadvertently pulled from the opening into its bladder, making the air mattress system inoperative.
Figure 6:
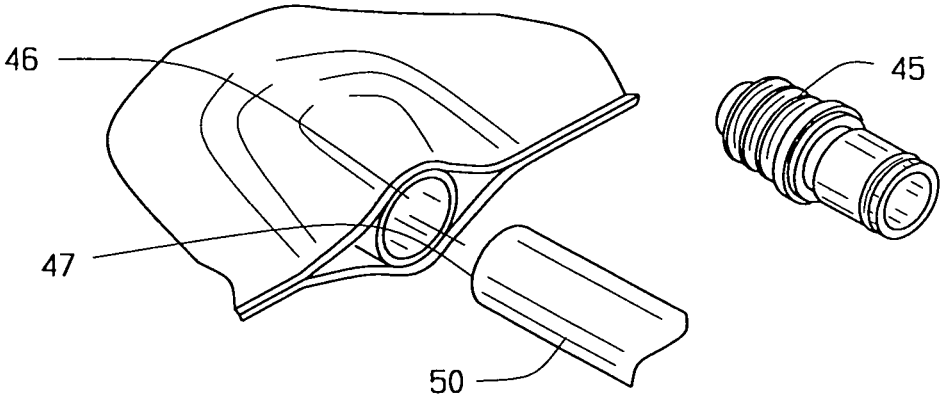
FIG. 6 shows the potential application of a length of hose for insertion within the open aperture of the air bladder in preparation for its repair.
Figure 7:
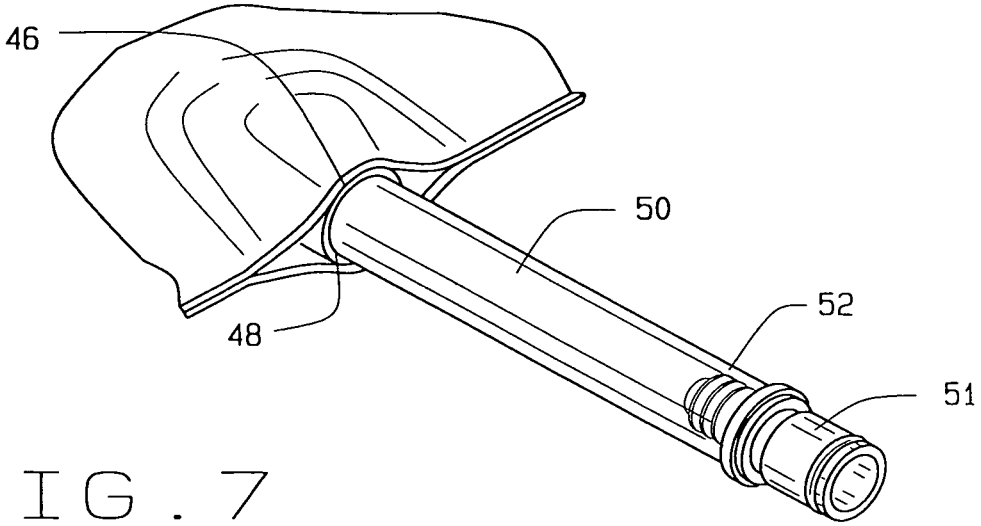
FIG. 7 provides an isometric view of the new connection made by insertion, and gluing, of the proximate end of the length of hose within the open hole of the air bladder, and having a new male fitting provided exteriorly from the bladder, in preparation for application of the air pump thereto, for the injection and regulation of air within the associated air bladder or mattress.

As can be seen in FIG. 5, a different form of breakage to the air injection system can be seen. In this instance, the male fitting 45 has broken entirely free from its location within the small hole or integral tube 46 for the air chamber, as noted. All of these components arranged internally of the air mattress, including its small hole or integral tube 46 are just that, integral, and are latex bonded, as at 48, within the air chamber, and cannot be removed without entirely destroying the functionality of the mattress. Nevertheless, the fitting or coupler 45, itself, is still functional, and has its O-ring seal 49 intact. To correct this problem, a segment of hose, as at 50, is aligned with the opening of the air chamber tube 46, and its front end, as at 47, is insertable within the opening of tube 46, and applied therein with an adhesive, whether it be an acrylic, latex or other polymer form of adhesive, that seals the end of the tube 50 within the air chamber, in preparation for reapplication of pressurized air therein. See FIG. 6. Then, as can be noted in FIG. 7, the tube segment 50 has been inserted and sealed within the opening of tube 46 within the bonded latex area 48 of the air mattress, which completely repairs the problem previously presented when the fitting 45 was inadvertently forcefully removed therefrom. This frequently occurs when the owner, tries to remove or install the pump, pulls to forcefully upon the fitting, breaking it free from its bonding within the air mattress, as noted. A length of hose 50 can have its end 47 adhesively applied into the opening of tube 46. A new fitting 51, or even in some instances, perhaps the old but usable fitting 45 is inserted into the other end 52 of the supplemental hose, secured tightly therein, and can now have the pump connected thereto for injection of compressed air, once again, into the air mattress, in order to attain the degree of firmness sought by the user for the comfort bed.

Figure 8A:
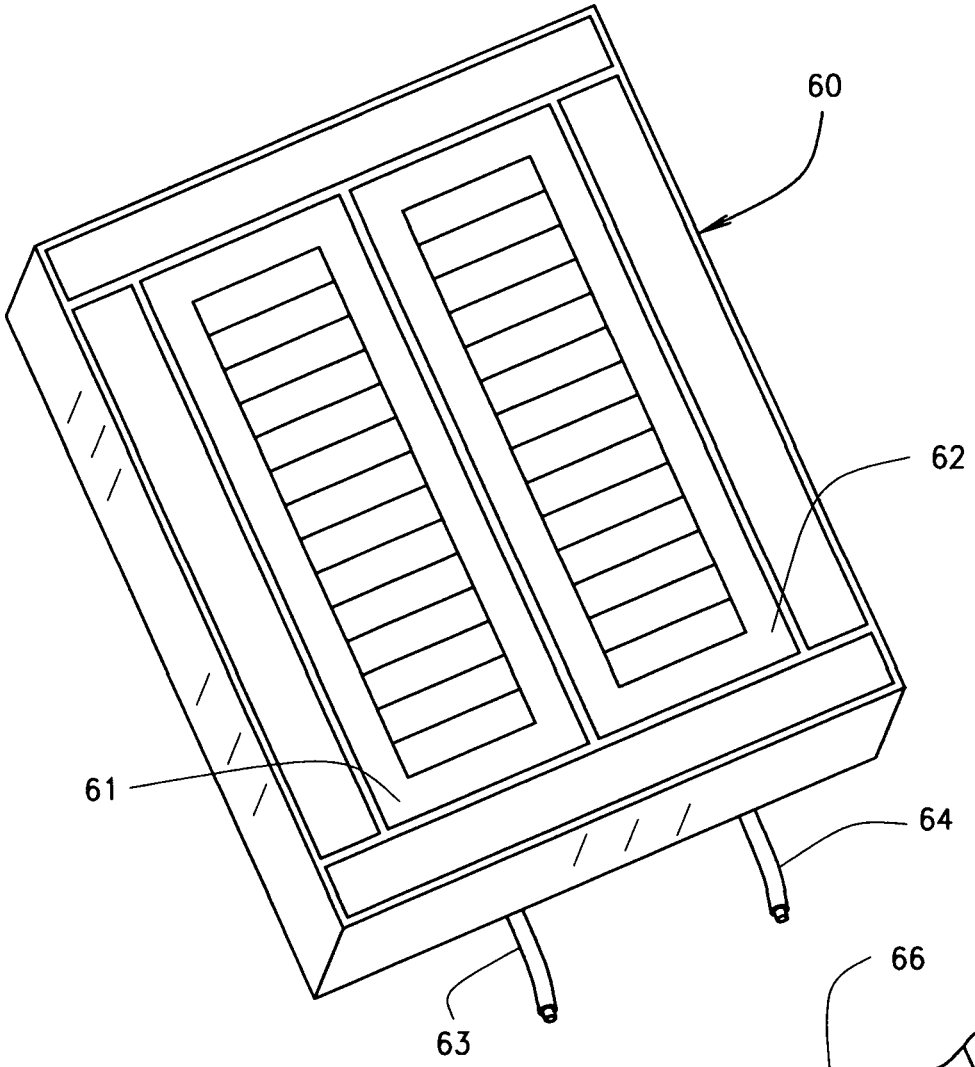
Figure 8B:
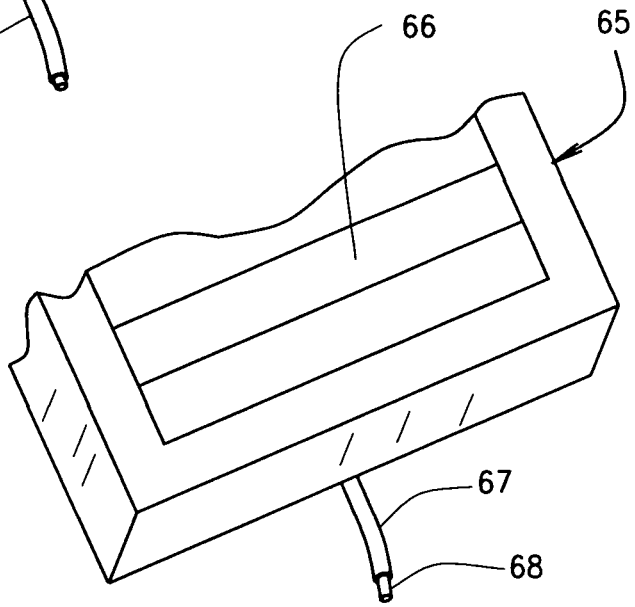

As can be seen in FIG. 8*a*, the mattress 60 as its dual size air inflatable sections 61 and 61, with its framework provided around the perimeter, as previously described, and a pair of tubing 63 and 64 that provides the intake for injection of pressurized air into each section of the inflatable mattress. FIG. 8*b* shows the mattress 65 and it includes a singular section of an air inflatable mattress 66, and a singular hose 67 with its fitting 68 extending downwardly therefrom. It is just as likely that the dual mattress of FIG. 8*a* could have the pair of hoses extending to each section of the mattress, so that one hose provides an air gauge for determining the amount of air pressure injected into the mattress, while the other hose provides the injection tubing for delivering pressurized air to that section of the mattress. This is related to what was described in FIGS. 1*a* and 1*b*. And, FIG. 8*b* could include a pair of hoses, for the same purpose. Thus, when the fittings break, or the hose is pulled free, the air leak repair hose of this current invention can be used for a prompt replacement, and repair, at little cost, to the benefit of the consumer.

These are examples as to how a method for remedying impairments that are generated within the injectable air mattress systems, so that the firmness for the injectable mattress can be established, at the desire of the user, and obviating the need to completely discard the entire mattress system, as heretofore was required, when such breakage occurred.

When the various fittings or couplers are applied either into the supplemental tubes, or their fittings or hoses are secured within the openings provided into the mattress air chambers, various adhesives may be applied to the associated components, when interconnected, so as to assure a firm securement of the pressurized air delivery systems together, and that they will not inadvertently slip apart, when a reasonable degree of force is applied thereto. Previously, they would break, necessitating a complete replacement of the entire air mattress system, at extensive expense.

Variations or modifications to the subject of this invention may occur to those skilled in the art upon review of the disclosure as provided herein. The description of the preferred embodiment for the development, the structural components employed, and their methods of assembly, in addition to the depiction within in the drawings, are primarily set forth for illustrative purposes only.

I claim:

1. An inflatable mattress and lining that can be filled by an air pump, and having mattress air fittings at respective entrance apertures, wherein one of the mattress air fittings at an entrance aperture has broken, the inflatable mattress comprising:

an air mattress and lining, said air mattress and lining having at least one air entrance aperture exposed by the one of the mattress air fittings having broken;

an air hose having entrance to at least one air chamber of the inflatable mattress via the exposed air entrance aperture;

said air hose having a first end and an opposite end, said first end of said air hose having a length extending into the air mattress and lining via the exposed air entrance aperture after being fitted into the exposed air entrance aperture to repair the air mattress, said air hose being adhesively secured within the air entrance aperture of said air mattress and forming an air tight seal within the air entrance aperture, an adhesive adhesively securing the first end of the air hose within the air entrance aperture to hold the air hose therein as repaired, said adhesive being one of acrylic, latex or polymer adhesives; and an additional air fitting secured with the opposite end of said air hose, said air fitting capable of hermetically connection with the air pump for the injection of air under pressure into the inflatable mattress to establish the required firmness for the mattress being inflated.

2. The air leak repair hose for the inflatable mattress and lining of claim 1 wherein said segment of air hose is between about 6 inches to 12 inches in length.

3. The air leak repair hose for the inflatable mattress and Lining of claim 1, wherein there are a pair of air leak repair hoses applied to the inflatable mattress.

4. The air leak repair hose for the inflatable mattress and lining of claim 1, wherein there are more than two of air leak repair hoses applied to the inflatable mattress.

5. The air leak repair hose for the inflatable mattress and lining of claim 1, wherein there are four air leak repair hoses applied to the inflatable mattress.

* * * * *